US011573014B2

(12) United States Patent
Liao et al.

(10) Patent No.: US 11,573,014 B2
(45) Date of Patent: Feb. 7, 2023

(54) AIR CONDITIONER

(71) Applicant: GREE ELECTRIC APPLIANCES, INC. OF ZHUHAI, Guangdong (CN)

(72) Inventors: Junjie Liao, Zhuhai (CN); Yingqiang Chen, Zhuhai (CN); Shuyun Li, Zhuhai (CN); Wandong Zhao, Zhuhai (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 240 days.

(21) Appl. No.: 17/047,060

(22) PCT Filed: Dec. 12, 2018

(86) PCT No.: PCT/CN2018/120690
§ 371 (c)(1),
(2) Date: Oct. 12, 2020

(87) PCT Pub. No.: WO2019/196469
PCT Pub. Date: Oct. 17, 2019

(65) Prior Publication Data

US 2021/0199314 A1 Jul. 1, 2021

(30) Foreign Application Priority Data

Apr. 12, 2018 (CN) ..... 201810324701.9

(51) Int. Cl.
*F24F 1/18* (2011.01)

(52) U.S. Cl.
CPC ..... *F24F 1/18* (2013.01)

(58) Field of Classification Search
CPC ..... F24F 1/18
See application file for complete search history.

(56) References Cited

FOREIGN PATENT DOCUMENTS

| | | | | |
|---|---|---|---|---|
| CN | 105004024 | A | 10/2015 | |
| CN | 105042724 | A | 11/2015 | |
| CN | 105066280 | A | 11/2015 | |
| CN | 204902043 | U | 12/2015 | |
| CN | 205261984 | U | 5/2016 | |
| EP | 3424614 | A1 | 5/1991 | |
| JP | H03129226 | A | 6/1991 | |
| JP | H11325505 | A | 11/1999 | |
| JP | 2003343878 | A | 12/2003 | |
| JP | 2013050234 | A | 3/2013 | |
| WO | 2016041289 | A1 | 3/2016 | |
| WO | WO-2016041289 | A1 * | 3/2016 | ..... F24F 1/14 |

OTHER PUBLICATIONS

WO-2016041289-A1 Translation (Year: 2016).*
Extended European Search Report for European Application No. 18913999.1 dated Apr. 28, 2021 (9 pages).

* cited by examiner

*Primary Examiner* — Schyler S Sanks
(74) *Attorney, Agent, or Firm* — J. Miguel Hernandez; James R. Gourley; Carstens, Allen & Gourley, LLP

(57) ABSTRACT

An air conditioner, including: a fan, an air blowing plane of the fan being an air blowing surface, the fan having a central axis, and the central axis being perpendicular to the air blowing surface; a separating plate configured to separate a compressor and a heat exchanger of the air conditioner; and an asymmetric heat exchanger, including a first side plate disposed comparatively far away from the separating plate and a second side plate disposed comparatively close to the separating plate.

16 Claims, 2 Drawing Sheets

AIR CONDITIONER

CROSS REFERENCE TO RELATED APPLICATION

This application claims the priority of Chinese patent application No. 201810324701.9, filed on Apr. 12, 2018, and entitled "ASYMMETRIC HEAT EXCHANGER AND AIR CONDITIONER", the disclosure of which is hereby incorporated by reference in its entirety. This application is a national phase under 35 U.S.C. § 120 of international patent application PCT/CN2018/120690, entitled "AIR CONDITIONER" filed on Dec. 12, 2018, the content of which is also hereby incorporated by reference.

TECHNICAL FIELD

The present disclosure belongs to the technical field of air conditioner, and specifically relates to an air conditioner.

BACKGROUND

In order to manufacture and install an existing U-shaped heat exchanger conveniently, a shape thereof is symmetrical. However, in an actual outdoor unit, because of limitation of an air inlet wall and influence of a separating plate, the area and the direction of inlet air on one side are influenced, and the inlet air on two sides is no longer symmetrical, so that a matching degree between an inlet air profile of the conventional heat exchanger, which is designed to allow symmetric inlet air, and an actual velocity of the inlet air is poor (that is, an included angle between the velocity of the inlet air and the inlet air profile of the heat exchanger is large), resulting in a high inlet air resistance, and affecting air blowing quantity of and energy consumption of a fan.

As the U-shaped heat exchanger known to the inventors has technical problems, such as, because of the influence of the separating plate, the matching degree between the inlet air profile of the heat exchanger and the actual velocity of the inlet air is poor, resulting in the high inlet air resistance, and affecting the air blowing quantity of the and the energy consumption of the fan, etc., the present disclosure provides an asymmetric heat exchanger and an air conditioner.

SUMMARY

In the U-shaped heat exchanger known to the inventors, because of the influence of the separating plate, the matching degree between the inlet air profile of the heat exchanger and the actual velocity of the inlet air is poor, resulting in the high inlet air resistance, and affecting the air blowing quantity and the energy consumption of the fan. In order to overcome defects of the U-shaped heat exchanger known to the inventors above, the present disclosure provides an air conditioner, including:

a fan, an air blowing plane of the fan being an air blowing surface, the fan having a central axis, and the central axis being perpendicular to the air blowing surface;

a separating plate, configured to separate a compressor and a heat exchanger of the air conditioner;

an asymmetric heat exchanger, including a first side plate disposed comparatively far away from the separating plate and a second side plate disposed comparatively close adjacent to the separating plate; and in a cross section of the heat exchanger, an included angle $\alpha$ is formed between the separating plate and the air blowing surface, an included angle $\beta$ formed between the second side plate and a normal line of the air blowing surface, and an included angle $\gamma$ formed between the separating plate and the normal line of the air blowing surface; when $\alpha$ is less than or equal to a preset angle, $\beta \leq \gamma$; when $\alpha$ is greater than the preset angle, $\beta > \gamma$; and an included angle $\theta$ is formed between the first side plate and the normal line of the air blowing surface, where $\theta \geq \beta$.

The present disclosure provides an asymmetric heat exchanger, including:

a first side plate disposed comparatively far away from a separating plate and a second side plate disposed comparatively adjacent to the separating plate, an air blowing plane of a fan being an air blowing surface, the fan having a central axis, and the central axis being perpendicular to the air blowing surface;

in a cross section of the heat exchanger, an included angle $\alpha$ is formed between the separating plate and the air blowing surface; an included angle $\beta$ is formed between the second side plate and a normal line of the air blowing surface; an included angle $\gamma$ is formed between the separating plate and the normal line of the air blowing surface; when $\alpha$ is less than or equal to a preset angle, $\beta \leq \gamma$, and when $\alpha$ is greater than the preset angle, $\beta > \gamma$; and an included angle $\theta$ is formed between the first side plate and the normal line of the air blowing surface, where $\theta \geq \beta$.

In some embodiments, a range of the preset angle is between 55° and 80°.

In some embodiments, in the cross section of the heat exchanger, a distance between a free end of the first side plate and the central axis is a first central axis distance Lb, and a distance between a free end of the second side plate and the central axis is a second central axis distance Rb, where Rb<Lb.

In some embodiments, $(Rb-Lb)=C(1-\cos\alpha)$, where C is a first constant term related to a machine type of the heat exchanger.

In some embodiments, a range of C is from 2% D to 50% D, where D is a diameter of the fan.

In some embodiments, the heat exchanger further includes an intermediate straight section connected between the first side plate and the second side plate, and a middle position of the intermediate straight section is located in the central axis, or the middle position of the intermediate straight section is located between the central axis and the first side plate.

In some embodiments, a first arc section is disposed at a joint of the intermediate straight section and the first side plate; a rounded corner of the first arc section is a first rounded corner with a first radius R1; a second arc section is disposed at a joint of the intermediate straight section and the second side plate; a rounded corner of the second arc section is a second rounded corner with a second radius R2; where R1>R2.

In some embodiments, there is $R_2-R_1=k(1-\cos\alpha)$, where k is a second constant term related to a machine type of the heat exchanger.

In some embodiments, when $\alpha$ first constant term C is also included, a range of k is from 5% C to 70% C.

In some embodiments, a first arc section is disposed at joint of the intermediate straight section and the first side plate; a rounded corner of the first arc section is a first rounded corner with a first radius R1; a second arc section is disposed at a joint of the intermediate straight section and the second side plate, and a rounded corner of the second arc section is a second rounded corner with a second radius R2; and R1=R2.

In some embodiments, the middle position of the intermediate straight section is located between the central axis and the first side plate; a distance between the intermediate position and the central axis is $$\frac{Rb - Lb}{2};$$

and Lb is a first central axis distance between a free end of the first side plate and the central axis, and Rb is a second central axis distance between a free end of the second side plate and the central axis.

In some embodiments, when the separating plate has a straight section structure, in the cross section of the heat exchanger, an included angle between the straight section structure and the air blowing surface is the included angle α;

when the separating plate has a curved section structure, in the cross section of the heat exchanger, a tangent line is drawn at a midpoint position in a length edge of the curved section, and an included angle between the tangent line and the air blowing surface is the included angle α; and when the separating plate has a structure with bent sections, in the cross section of the heat exchanger, an included angle is formed between each bent section and the air blowing surface, and an average value of included angles each formed between one bent section and the air blowing surface is the included angle α.

In some embodiments, the cross section of the heat exchanger is a U-shaped structure, and the fan is disposed on a concave side of the U-shaped structure.

The present disclosure also provides an air conditioner, including any one of the asymmetric heat exchangers above, and the air conditioner further includes a separating plate and a fan. The first side plate is disposed far away from the separating plate, and the second side plate being is disposed adjacent to the separating plate.

In the asymmetric heat exchanger and the air conditioner of the present disclosure, when the included angle α between the separating plate and the air blowing surface is less than or equal to the preset angle, the included angle β between the second side plate and the normal line of the air blowing surface is less than or equal to the included angle γ between the separating plate and the normal line of the air blowing surface; when the included angle α between the separating plate and the air blowing surface a is greater than the preset angle, the included angle β between the second side plate and the normal line of the air blowing surface is greater than or equal to the included angle γ between the separating plate and the normal line of the air blowing surface; and the included angle θ between the first side plate and the normal line of the air blowing surface is greater than or equal to the included angle β between the second side plate and the normal line of the air blowing surface, so that a shape of the first side plate better matches an isovelocity surface of the free airflow on the left, and a shape of the second side plate better matches an isovelocity surface of airflow on the right, which is restricted by the separating plate, in order to ensure that entering angles of various parts of airflow are suitable for overall flow of the structure having the separating plate, and to reduce the local flow loss caused by deflection of the airflow passing through the heat exchanger and reduce energy consumption of the fan.

In the asymmetric heat exchanger and air conditioner of the present disclosure, the distance Rb between a side of the heat exchanger adjacent to the separating plate and the central axis is less than the distance Lb between a free side of the heat exchanger and the central axis. As the isovelocity surface changes in a manner of spreading at the left and contracting at the right, the profile of the heat exchanger should be adapted for the change, thereby improving uniformity of inlet air on the left and right, reducing inlet air resistance, and improving heat exchange efficiency. In some embodiments, changes are based on a rule of (Rb−Lb)=C (1−cos α), where C is the first constant term related to the machine type, which further enables the profile of the heat exchanger approximate to the isovelocity surface (or isobaric surface) of the airflow.

In the asymmetric heat exchanger and the air conditioner of the present disclosure, the middle position of the intermediate straight section of the heat exchanger should coincide with the center axis of the fan, and in some embodiments, the sizes of the left rounded corner and the right rounded corner are identical or different. If the left rounded corner and the right rounded corner are provided to have different sizes, in a solution of some embodiments, the profile structure of the heat exchanger having the rounded corner with a large radius R1 on the left and the rounded corner with a small radius R2 on the right (i.e., R1>R2) is formed according to the form of the above large isovelocity surface on the left and the small isovelocity surface on the right, so as to improve the matching degree of the profile surface of the heat exchanger and the isovelocity surface, improve the uniformity of inlet air at the rounded corners, reduce the inflow resistance, and improve the heat exchange efficiency. In some embodiments, the relationship between the left rounded corner and the right rounded corner is $R_1-R_2=k(1-\cos\alpha)$ (where k is the second constant term related to the machine type), which further enables the profile of the heat exchanger to be proximate to the isovelocity surface (or isobaric surface) of the airflow.

DETAILED DESCRIPTION OF THE EMBODIMENTS

Figure 1:
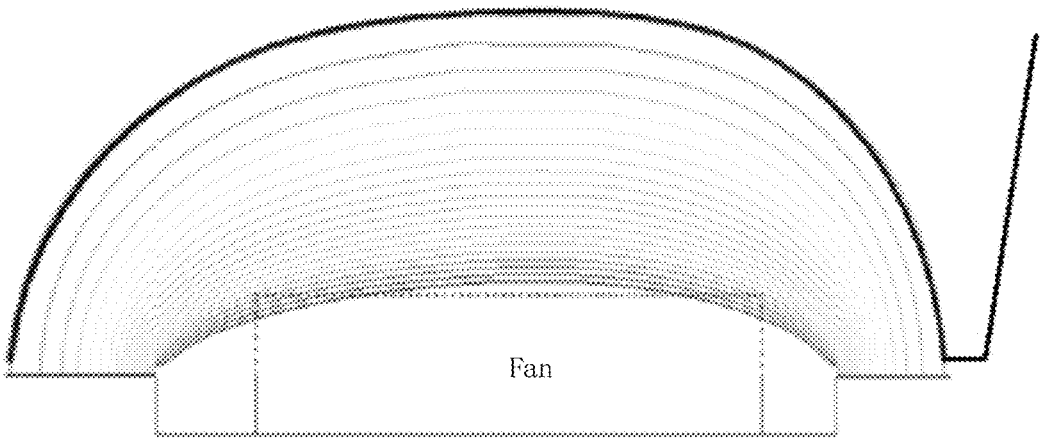
FIG. 1 is a diagram illustrating isobaric lines (or isovelocity lines) of airflow of an asymmetric heat exchanger of the present disclosure.
Figure 2:
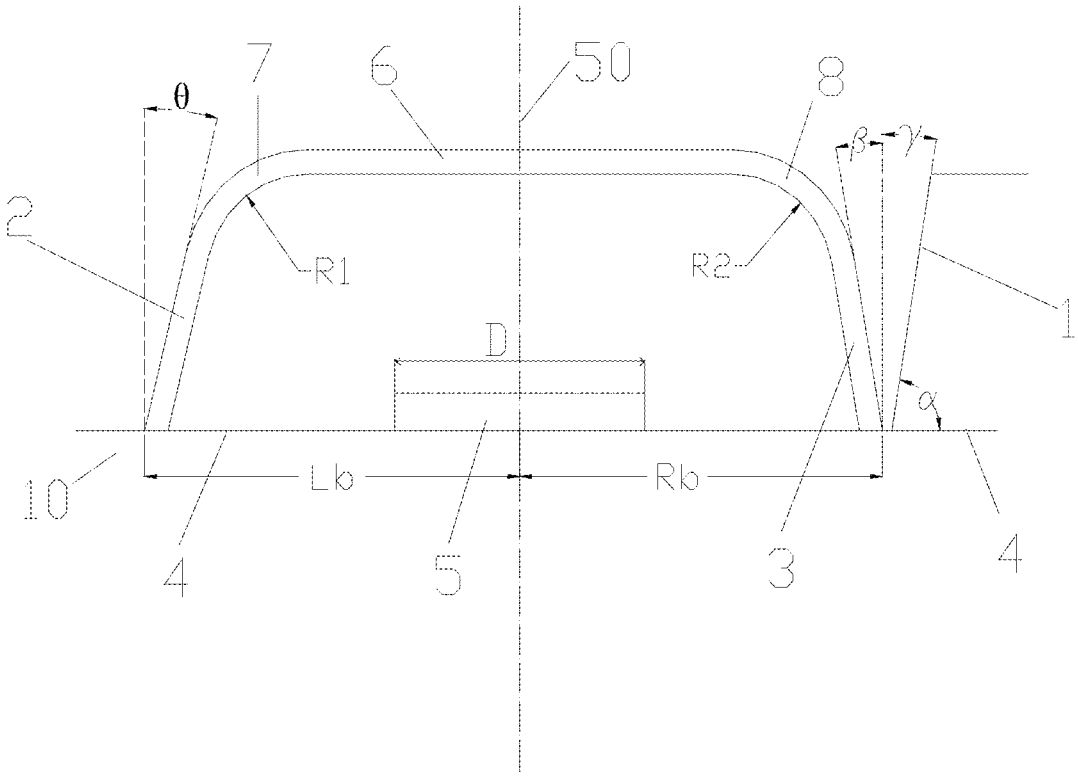
FIG. 2 is a cross-sectional structure diagram of the asymmetric heat exchanger of the present disclosure.
Figure 3:
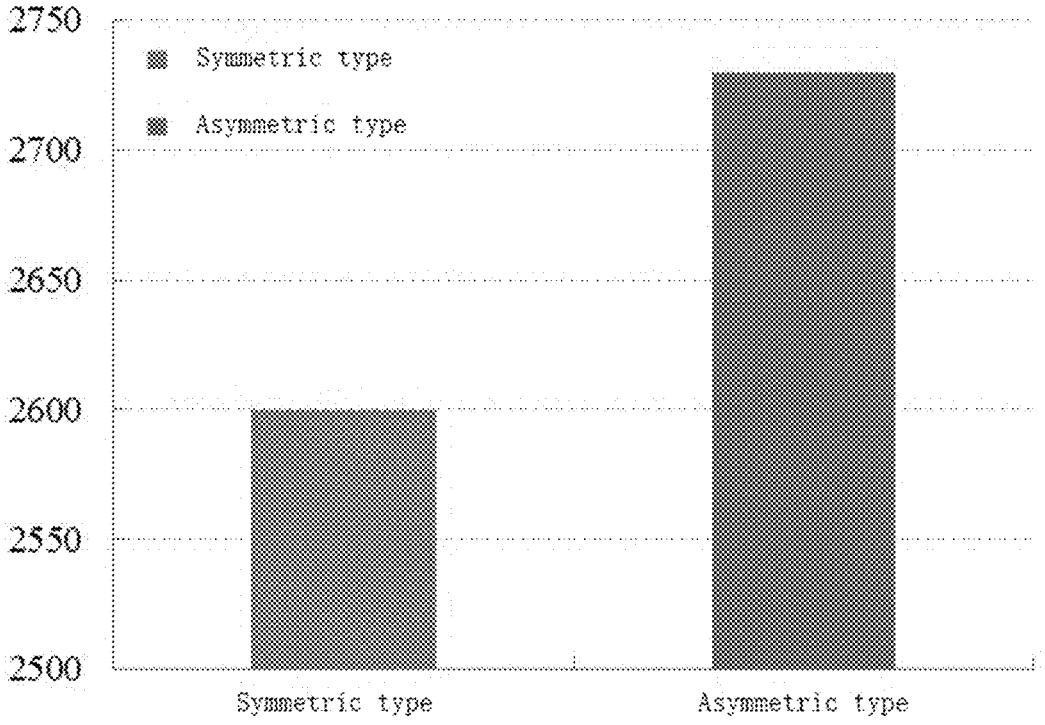
FIG. 3 is a bar graph illustrating a comparison of air quantity between an existing symmetric heat exchanger and the asymmetric heat exchanger of the present disclosure.

As shown in FIGS. 1 to 3, the present disclosure provides an air conditioner, including: a fan 5, an air blowing plane of the fan 5 being an air blowing surface 4, the fan 50 having a central axis 50, and the central axis 50 being perpendicular to the air blowing surface 4; a separating plate 1, configured to separate a compressor and a heat exchanger of the air conditioner; an asymmetric heat exchanger, including a first side plate 2 disposed comparatively far away from the separating plate 1 and a second side plate 3 disposed comparatively adjacent to the separating plate 1.

In a cross section of the heat exchanger, an included angle α is formed between the separating plate 1 and the air blowing surface 4; an included angle β is formed between the second side plate 3 and a normal line of the air blowing surface 4; and an included angle γ is formed between the separating plate 1 and the normal line of the air blowing surface 4. When α is less than or equal to a preset angle, β≤γ;

when α is greater than the preset angle, β>γ; and an included angle θ is formed between the first side plate 2 and the normal line of the air blowing surface 4, where θ≥β.

When the included angle α between the separating plate 1 and the air blowing surface is less than or equal to the preset angle, the included angle β between the second side plate 3 and the normal line of the air blowing surface is less than or equal to the included angle γ between the separating plate 1 and the normal line of the air blowing surface; when the included angle α between the separating plate 1 and the air blowing surface is greater than the preset angle, the included angle β between the second side plate 3 and the normal line of the air blowing surface is greater than or equal to the included angle γ between the separating plate 1 and the normal line of the air blowing surface; and the included angle θ between the first side plate 2 and the normal line of the air blowing surface is greater than or equal to the included angle β between the second side plate 3 and the normal line of the air blowing surface. Accordingly, a shape of the first side plate 2 better matches an isovelocity surface of the free airflow on the left, and a shape of the second side plate 3 better matches an isovelocity surface of the airflow on the right, which is restricted by the separating plate 1 arranged, thereby ensuring that entering angles of various parts of airflow are suitable for overall flow of the structure having the separating plate (1), reducing the local flow loss of the airflow caused by deflection of the airflow passing through the heat exchanger (10) and reducing energy consumption of the fan.

Specifically, when the included angle α formed between the separating plate 1 and the air blowing surface is less than or equal to the preset angle, the included angle β between the second side plate 3 and the normal line of the air blowing surface is less than or equal to the included angle γ between the separating plate 1 and the normal line of the air blowing surface, so that, as shown in FIG. 2, when the separating plate 1 inclines downward and to the right, the second side plate 3 is adjacent to the separating plate 1 as much as possible. Accordingly, the second side plate 3 and the separating plate 1 are spaced by a distance not too large, thereby avoiding an overlarge gap therebetween which will cause the airflow not to effectively exchange heat (at this time, influence of the separating plate 1 on the airflow is comparatively small, and the second side plate 3 should spread to the right according to a similar situation where no separating plate is provided). In this case, a shape of a surface of the second side plate 3 is consistent with the isovelocity surface of surrounding airflow. When the included angle α between the separating plate and the air blowing surface is greater than the preset angle, the included angle β between the second side plate 3 and the normal line of the air blowing surface is greater than or equal to the included angle γ between the separating plate and the normal line of the air blowing surface, so that, as shown in the figure, when the separating plate is adjacent to the left, the second side plate 3 keeps away from a side of the separating plate as much as possible. Accordingly, the second side plate 3 and the separating plate are spaced by a not too small distance, thereby avoiding a too small gap therebetween which will cause losses such as airflow squeezing. In this case, the shape of the surface of the second side plate 3 is consistent with the isovelocity surface of the surrounding airflow. The inlet air is restricted at the side of the separating plate, therefore a corresponding isovelocity surface of the inlet air changes, and the isovelocity surface of a restricted airflow on the right contracts toward a fan side, and the isovelocity surface of a free airflow on the left spreads toward an environmental side. According to the present disclosure, the included angle θ between the first side plate 2 and the normal line of the air blowing surface is greater than or equal to the included angle β between the second side plate 3 and the normal line of the air blowing surface, so that the profile of the heat exchanger of the restricted part on the right contracts toward the fan side, and the profile of the heat exchanger of the free part on the left spreads toward the environment side. The present disclosure enables the shape of the first side plate 2 to better match the isovelocity surface of the airflow, and the shape of the second side plate 3 to better match the isovelocity surface of the restricted airflow there, so that the entering angles of various parts of airflow are suitable for overall flow of the structure having the separating plate, thereby reducing local flow loss caused by the deflection of the airflow passing through the heat exchanger, and reducing the energy consumption of the fan.

The actual inlet air of the outdoor unit having a separating plate does not conform to symmetrically inlet air. The conventional symmetric heat exchanger has a poor adaptability to the integral isovelocity surface of the inlet air, which makes the resistance of the inlet air large. In view of this, the present disclosure specifically optimizes and reduce the resistance. The inlet air at the separating plate side is restricted, and corresponding isovelocity surface of the inlet air changes; the isovelocity surface of the restricted airflow on the right contracts toward the fan side, and the isovelocity surface of the free airflow on the left spreads toward the environmental side; and there is no obvious change in the isovelocity surface in the intermediate part. The U-shaped heat exchanger designed correspondingly also needs to change according to these regular patterns, forming the asymmetric U-shaped heat exchanger having the separating plate.

In some embodiments, based on different machine types of the heat exchangers, the preset angle is selected in a range from 55° to 80°. This is a numerical range of the preset angle of the present disclosure. In some embodiments, the preset angle is 80°. According to a large number of experimental studies, when the included angle α between the separating plate and the air blowing surface is equal to 80°, the separating plate and the second side plate 3 are symmetrical with respect to the normal line of the air blowing surface, and moreover, the isovelocity surface of inlet airflow and the first side plate 2 basically fit. When α<80°, the isovelocity surface is offset to the right, then the first side plate 2 needs to be offset to the right, and when α>80°, the isovelocity surface is offset to the left, then the first side plate 2 needs to be offset to the left, in order to ensure that the shape of the first side plate 2 matches the isovelocity surface of the airflow, thereby reducing wind resistance and the energy consumption of the fan.

In dealing with the asymmetry of the inlet air in the actual outdoor unit, the original symmetric heat exchanger does not match the actual inlet air, therefore the shape of the heat exchanger that satisfies following design requirements of the inlet air of the asymmetric heat exchanger is employed: the asymmetric inlet air on the right is mainly determined by the included angle α between the separating plate on the right and the air blowing surface, and when α≤80°, the included angle β between an adjacent edge of the adapted asymmetric U-shaped heat exchanger and the normal line of the air blowing surface is not greater than the included angle γ between the separating plate and the normal line of the air blowing surface, and when α>80°, the included angle β between the adjacent edge of the adapted asymmetric U-shaped heat exchanger and the normal line of the air blowing surface should be greater than the included angle γ between the separating plate and the normal line of the air blowing surface, and the included angle θ between a left side edge of the heat exchanger and the normal line of the air blowing surface should not be less than the included angle β on the right, in order to ensure that the entering angles of various parts of airflow are suitable for overall flow of the structure having the separating plate, and reduce local flow loss caused by the deflection of the airflow passing through the heat exchanger.

In some embodiments, in the cross section of the heat exchanger, a distance between a free end of the first side plate 2 and the central axis 50 is a first central axis distance Lb, and a distance between a free end of the second side plate 3 and the central axis 50 is a second central axis distance Rb, where Rb<Lb. The distance Rb between a side of the heat exchanger adjacent to the separating plate and the central axis is less than the distance Lb between a free side of the heat exchanger and the central axis. As the isovelocity surface changes in a manner of spreading at the left and shrinking at the right, the profile of the heat exchanger should be adapted for this change, thereby improving uniformity of inlet air on the left and right, reducing inlet air resistance, and improving the heat exchange efficiency.

In some embodiments, $(Rb-Lb)=C(1-\cos\alpha)$, where C is a first constant term related to the machine type of the heat exchanger, and the range of C is between 2% D and 50% D, and in some further embodiments, between 5% D to 15% D, where D is a diameter of the fan. By establishing such a formula, an interrelationship between the first central axis distance Lb, the second central axis distance Rb and the included angle α of the separating plate are established, that is, a difference between the first central axis distance Lb and the second central axis distance Rb is directly related to $1-\cos\alpha$. For example, when the separating plate inclines to the right, α decreases, and $1-\cos\alpha$ decreases, at this time, the influence of the separating plate on the inlet airflow of the fan and the heat exchanger is small, thus the difference between Rb and Lb should also be decreased to adapt itself for the change of the isovelocity surface (or isobaric surface) of the airflow; when the separating plate inclines to the left, α increases, and $1-\cos\alpha$ increases, at this time, the influence of the separating plate on the inlet airflow of the fan and the heat exchanger is large, thus the difference between Rb and Lb should also be increased to adapt itself for the change of the isovelocity surface (or isobaric surface) of the airflow. Through the above relationship, the profile of the asymmetric heat exchanger is adjusted to be consistent with the isovelocity surface of the airflow to the greatest extent because of the influence of the separating plate, thus reducing resistance and improving the heat exchange efficiency. The range of C is between 2% D and 50% D, in some further embodiments, between 5% D and 15% D. In some embodiments, the value of the first constant term is limited according to the diameter of the fan, so that a relationship between Lb, Rb, α and the diameter of the fan is established, and that the isovelocity surface or the isobaric surface of the heat exchanger matching the size of the fan is further produced.

In some embodiments, the heat exchanger further includes an intermediate straight section 6 connected between the first side plate 2 and the second side plate 3, and a middle position of the intermediate straight section 6 is located in the central axis 50, or the middle position of the intermediate straight section 6 is located between the central axis 50 and the first side plate 2. The middle position of the intermediate straight section of the heat exchanger should coincide with the central axis of the fan, or not coincide with the central axis of the fan. However, if it does not coincide with the central axis of the fan, the middle position of the intermediate straight section should be disposed on the left to the greatest extent, that is, located between the central axis 50 and the first side plate 2. Such a structure enables the profile of the heat exchanger to be far away from the separating plate as much as possible, thus reducing the influence of the arranged separating plate on a distribution of the airflow, enabling the profile of the heat exchanger to match the isovelocity surface of the airflow, and reducing the wind drag and the energy consumption of the fan.

In some embodiments, a first arc section 7 is disposed at a joint of the intermediate straight section 6 and the first side plate 2, a rounded corner of the first arc section 7 is a first rounded corner with a first radius R1; a second arc section 8 is disposed at a joint of the intermediate straight section 6 and the second side plate 3, and a rounded corner of the second arc section 8 is a second rounded corner with a second radius R2, where R1>R2. In some embodiments, the sizes of the left rounded corner and the right rounded corner are identical or different. If the left rounded corner and the right rounded corner are provided to have different sizes, in a solution of some embodiments, the profile structure of the heat exchanger having the rounded corner with a large radius R1 on the left and the rounded corner with a small radius R2 on the right (i.e., R1>R2) is formed according to a form of the above isovelocity surface large on the left and small on the right, so as to improve the matching degree of the profile structure of the heat exchanger and the isovelocity surface, improve uniformity of inlet air at the rounded corners, reduce the inflow resistance, and improve the heat exchange efficiency. In some embodiments, a relationship of the left rounded corner and the right rounded corner is $R_1-R_2=k(1-\cos\alpha)$ (where k is a specific constant term related to the machine type). Such an arrangement further enables the profile of the heat exchanger to approximate to the isovelocity surface (or the isobaric surface) of the airflow.

In some embodiments, $R_2-R_1=k(1-\cos\alpha)$, where k is a second constant term related to the machine type of the heat exchanger. When the first constant term C is also included, the range of k is between 5% C and 70% C, and in some embodiments, between 8% C and 30% C. In some embodiments, by establishing such a formula, the relationship between the first rounded corner R1, the second rounded corner R2 and the included angle α of the separating plate is established, that is, the difference between the second rounded corner R2 and the first rounded corner R1 is directly related to $1-\cos\alpha$. For example, when the separating plate inclines to the right, a decreases, and $1-\cos\alpha$ decreases; at this time, the influence of the separating plate on the inlet airflow of the fan and the heat exchanger is small, thus the difference between R1 and R2 should also be decreased, so as to make the left and right side plates as symmetrical as possible and to be adapted for the change of the isovelocity surface (or the isobaric surface) of the airflow. When the separating plate inclines to the left, a increases, and $1-\cos\alpha$ increases; at this time, the influence of the separating plate on the inlet airflow of the fan and the heat exchanger is large, thus the difference between R1 and R2 should also be increased, so as to enable the free end of the first side plate 2 to spread outward (i.e. to the left) and the free end of the second side plate 3 to contract inward (to the left) as far as possible to adapt to the change of the isovelocity surface (or isobaric surface) of the airflow. In some embodiments, through the above relationship, on the basis of the influence of the separating plate, the profile of the asymmetric heat exchanger can is adjusted to be consistent with the isovelocity surface of the airflow to the greatest extent, thus reducing resistance and improving the heat exchange efficiency. The range of k is between 5% C and 70% C, and in some embodiments, between 8% C and 30% C. The magnitude of the second constant term is restricted according to the diameter of the fan, so that: R1, R2, α are related to the diameter of the fan; that the second constant term and the first constant term are related to each other; and the two rounded corners together with two distances relative to the central axis further enable the isovelocity surface or the isobaric surface of the heat exchanger to be formed to match the size of the fan.

In some embodiments, the first arc section 7 is disposed at a joint of the intermediate straight section 6 and the first side plate 2, and a rounded corner of the first arc section 7 is a first rounded corner with a first radius R1; the second arc section 8 is disposed at the joint of the intermediate straight section 6 and the second side plate 3, and a rounded corner of the second arc section 8 is the second rounded corner with a second radius R2, where R1=R2. The second rounded corner of the heat exchanger is adjacent to the separating plate; the first rounded corner of the heat exchanger is far away from the separating plate; and the radius R2 of the second rounded corner is equal to the radius R1 of the first rounded corner, that is, sizes of the rounded corners formed on two sides are identical, which improves the uniformity of inlet air on the left and right sides, reduces the inlet airflow resistance, and improves the heat exchange efficiency.

In some embodiments, the middle position of the intermediate straight section 6 is located between the central axis and the first side plate 2, and a distance between the intermediate position and the central axis 50 is $$\frac{Rb - Lb}{2},$$

where Lb is the first central axis distance, that is, the distance between the free end of the first side plate 2 and the central axis 50; and Rb is the second central axis distance, that is, the distance between the free end of the second side plate 3 and the central axis 50. This is an optional configuration form of the heat exchanger having rounded corners with same size of the present disclosure, that is, the intermediate straight section, the first side plate 2 and the second side plate 3 are shifted to the left as a whole. Since the rounded corners are identical, the included angle θ formed at the free end of the first side plate 2 is also equal to the included angle β formed at the free end of the second side plate 3. In this case, the whole heat exchanger is shifted to the left, which reduces the influence of the separating plate on the inlet airflow of the heat exchanger, reduce the wind resistance, and improve the heat exchange efficiency.

In some embodiments, when the separating plate 1 has a straight section structure, in the cross section of the heat exchanger, an included angle between the straight section structure and the air blowing surface 4 is the included angle α;

when the separating plate 1 has a curved section structure, in the cross section of the heat exchanger, a tangent line is drawn at a midpoint position of a long edge of the curved section, and an included angle between the tangent line and the air blowing surface 4 is the included angle α; and when the separating plate 1 has a structure with bent sections, in the cross section of the heat exchanger, an included angle is formed between each bent section and the air blowing surface 4, and an average value of included angles each formed between one bent section and the air blowing surface 4 is the included angle α.

These are several different structural forms of the separating plate of the present disclosure, that is, the straight section structure, the curved section structure and the bent section structure, and the included angle α corresponding to each structural form is definitely defined, so that the included angle α is determined easily.

In some embodiments, the cross section of the heat exchanger is a U-shaped structure, and the fan 5 is disposed on a concave side of the U-shaped structure. In this way, several sections of the heat exchanger can perform heat exchange with the airflow via air suction or air blowing, thus the heat exchange efficiency is improved.

The present disclosure also provides an air conditioner, including any one of the asymmetric heat exchangers 10 described above. The air conditioner further includes a separating plate 1 and a fan 5; the first side plate 2 is disposed far away from the separating plate 1; and the second side plate 3 is disposed adjacent to the separating plate 1. In some embodiments, the asymmetric heat exchanger 10 is located at a windward side of the fan 5.

In order to deal with the actual situation of the asymmetry inlet air in the outdoor unit, the symmetric heat exchanger known to the inventors does not match the actual air inlet, therefore the shape of the heat exchanger that satisfies following design requirements for the inlet air of the asymmetric heat exchanger is adopted: the asymmetric inlet air on the right is mainly determined by the included angle α between the separating plate on the right and the air blowing surface; when α≤80° the included angle β between the adjacent edge of the adapted asymmetric U-shaped heat exchanger and the normal line of the air blowing surface is not greater than the included angle γ between the separating plate and the normal line of the air blowing surface; when α>80°, the included angle β between the adjacent edge of the adapted asymmetric U-shaped heat exchanger and the normal line of the air blowing surface must be greater than the included angle γ between the separating plate and the normal line of the air blowing surface; and the included angle θ between the left side edge of the heat exchanger and the normal line of the air blowing surface should not be less than the included angle β on the right, in order to ensure that the entering angles of various parts of airflow are suitable for overall flow of the structure having the separating plate, to reduce the local flow loss caused by deflection of the airflow passing through the heat exchanger.

The above are only preferred embodiments of the present disclosure, but are not intended to limit the present disclosure. Any modification, equivalent replacement, and improvement, etc. made within the spirit and the principle of the present disclosure are in the protection scope of the present disclosure. The above are only preferred embodiments of the present disclosure, and it should be noted that, for those of ordinary skill in the art, various improvements and modifications can be made without departing from the technical principles of the present disclosure. These improvements and modifications should also be regarded as the protection scope of the present disclosure.

What is claimed is:

1. An air conditioner, comprising:

a fan, an air blowing plane of the fan being an air blowing surface, the fan having a central axis, and the central axis being perpendicular to the air blowing surface;

a separating plate configured to separate a compressor and a heat exchanger of the air conditioner; and an asymmetric heat exchanger, comprising a first side plate disposed comparatively far away from the separating plate and a second side plate disposed comparatively adjacent to the separating plate;

wherein in a cross section of the heat exchanger, an included angle $\alpha$ is formed between the separating plate and the air blowing surface; an included angle $\beta$ is formed between the second side plate and a normal line of the air blowing surface; and an included angle $\gamma$ is formed between the separating plate and the normal line of the air blowing surface (4); when $\alpha$ is less than or equal to a preset angle, $\beta \leq \gamma$; when $\alpha$ is greater than the preset angle, $\beta > \gamma$; and an included angle $\theta$ is formed between the first side plate and the normal line of the air blowing surface, wherein $\theta \geq \beta$; and in the cross section of the heat exchanger, a distance between a free end of the first side plate and the central axis is a first central axis distance Lb, and a distance between a free end of the second side plate and the central axis is a second central axis distance Rb, and Rb<Lb.

2. The air conditioner according to claim 1, wherein a range of the preset angle is between 55° and 80°.

3. The air conditioner according to claim 1, wherein $(Rb-Lb)=C(1-\cos\alpha)$, and C is a first constant term related to a machine type of the heat exchanger.

4. The air conditioner according to claim 3, wherein a range of C is from 2% D to 50% D, and D is a diameter of the fan.

5. The air conditioner according to claim 1, wherein the heat exchanger further comprises an intermediate straight section connected between the first side plate and the second side plate, and a middle position of the intermediate straight section is located in the central axis, or the middle position of the intermediate straight section is located between the central axis and the first side plate.

6. The air conditioner according to claim 5, wherein a first arc section is disposed at a joint of the intermediate straight section and the first side plate; a rounded corner of the first arc section is a first rounded corner with a first radius R1; a second arc section is disposed at a joint of the intermediate straight section and the second side plate; a rounded corner of the second arc section is a second rounded corner with a second radius R2; and R1>R2.

7. The air conditioner according to claim 6, wherein $R_2-R_1=k(1-\cos\alpha)$, and k is a second constant term related to a machine type of the heat exchanger.

8. The air conditioner according to claim 7, wherein a range of k is from 5% C to 70% C, and C is a first constant term related to a machine type of the heat exchanger.

9. The air conditioner according to claim 5, wherein a first arc section is disposed at joint of the intermediate straight section and the first side plate; a rounded corner of the first arc section is a first rounded corner with a first radius R1; a second arc section is disposed at a joint of the intermediate straight section and the second side plate, and a rounded corner of the second arc section is a second rounded corner with a second radius R2; and R1=R2.

10. The air conditioner according to claim 9, wherein the middle position of the intermediate straight section is located between the central axis and the first side plate; a distance between the intermediate position and the central axis is $$\frac{Rb-Lb}{2};$$

and Lb is a first central axis distance between a free end of the first side plate and the central axis, and Rb is a second central axis distance between a free end of the second side plate and the central axis.

11. The air conditioner according to claim 1, wherein when the separating plate has a straight section structure, in the cross section of the heat exchanger, an included angle between the straight section structure and the air blowing surface is the included angle $\alpha$;

when the separating plate has a curved section structure, in the cross section of the heat exchanger, a tangent line is drawn at a midpoint position in a long edge of the curved section, and an included angle between the tangent line and the air blowing surface is the included angle $\alpha$; and when the separating plate has a structure with bent sections, in the cross section of the heat exchanger, an average value of included angles each formed between one bent section and the air blowing surface is the included angle $\alpha$.

12. The air conditioner according to claim 1, wherein the cross section of the heat exchanger is a U-shaped structure, and the fan is disposed on a concave side of the U-shaped structure.

13. The air conditioner according to claim 2, wherein the preset angle is 80°.

14. The air conditioner according to claim 4, wherein the range of C is from 5% D to 15% D.

15. The air conditioner according to claim 8, wherein the range of k is from 8% C to 30% C.

16. The air conditioner according to claim 5, wherein a range of the preset angle is between 55° and 80°.

* * * * *